US005458807A

United States Patent [19]

Tamoto

[11] Patent Number: 5,458,807

[45] Date of Patent: Oct. 17, 1995

[54] ENGINE OIL COMPOSITION

[75] Inventor: Yoshitaka Tamoto, Ichihara, Japan

[73] Assignee: Idemitsu Kosan Co., Ltd., Tokyo, Japan

[21] Appl. No.: 238,788

[22] Filed: May 6, 1994

Related U.S. Application Data

[63] Continuation of Ser. No. 985,118, Dec. 3, 1992, abandoned.

[30] Foreign Application Priority Data

Dec. 12, 1991 [JP] Japan ..... 3-328772

[51] Int. Cl.[6] ..... C10M 141/10

[52] U.S. Cl. ..... 252/32.7 E; 252/33.6; 252/38; 252/39; 252/49.7

[58] Field of Search ..... 252/32.7 E, 33.6, 252/38, 39, 49.7

[56] References Cited

U.S. PATENT DOCUMENTS

| | | | |
|---|---|---|---|
| 3,772,196 | 11/1973 | St. Clair et al. | 252/32.7 E |
| 4,164,473 | 8/1979 | Coupland et al. | 252/32.7 E |
| 4,776,967 | 10/1988 | Ichihashi et al. | 252/32.7 E |
| 4,948,522 | 8/1990 | Dunn et al. | 252/32.7 E |
| 4,960,542 | 10/1990 | Seiki | 252/565 |

FOREIGN PATENT DOCUMENTS

| | | |
|---|---|---|
| 0067002 | 12/1982 | European Pat. Off. . |
| 0113045 | 11/1984 | European Pat. Off. . |
| 0391651 | 10/1990 | European Pat. Off. . |
| 0447916 | 9/1991 | European Pat. Off. . |
| 42-008014 | of 1967 | Japan . |
| 42-008013 | of 1967 | Japan . |
| 51-130408 | of 1976 | Japan . |
| 51-052381 | of 1976 | Japan . |
| 54-087705 | of 1979 | Japan . |

*Primary Examiner*—P. Achutamurthy
*Attorney, Agent, or Firm*—Antonelli, Terry, Stout & Kraus

[57] ABSTRACT

There is disclosed an engine oil composition which comprises as the essential components (A) a base oil comprising either or both of a mineral oil and a synthetic oil, (B) a boron compound derivative of alkenylsuccinimide, (C) an alkaline earth metal salt of salicylic acid and (D) either or both of a molybdenum dithiophosphate and a molybdenum dithiocarbamate. The above engine oil composition can effectively be used as a lubricating engine oil in automobiles and various industrial internal combustion engines by virtue of reduced friction loss of an engine by the use thereof and its low friction properties both in the early stages of use and after being used for a certain period of time.

8 Claims, No Drawings

ENGINE OIL COMPOSITION

This application is a continuation application of application Ser. No. 985,118, filed Dec. 3, 1992, abandoned.

BACKGROUND OF THE INVENTION

1. Field of the Invention

The present invention relates to an engine oil composition. More particularly it relates to an engine oil composition capable of reducing the friction loss in an engine and having the low friction properties not only in the early stages of use but also after it is used for a certain period of time.

2. Description of Related Arts

A lubricating engine oil for automobiles and various industrial internal combustion engines must have many properties. For example, the lubricating engine oil should (1) have good detergency, (2) be excellent in wear resistance and (3) highly stable against heat and oxidation, (4) have low oil consumption, (5) permit the engine to have a low friction loss and the like. Particularly, the property of permitting the engine to have a low friction loss as set forth in (5) above is particularly important from the viewpoint of saving energy and protecting the earth's environment from $CO_2$ and the like.

In an attempt to meet this requirement, there have been conventionally used the technics wherein molybdenum dithiophosphate, molybdenum dithiocarbamate or like is added to the engine oil as a friction modifier (Japanese Patent Application Laid Open No.215697/1987 and Japanese Patent Publication No. 23595/1991).

However, various problems are inherent in these related arts. For example,

1) Certainly, the addition of friction modifier is effective to reduce the friction loss of the engine, but the added friction modifier is liable to be adversely affected by other additives contained in the engine oil, and there is a possibility that the effect of adding the chemical is variation-ridden and unstable.

2) Another problem is that the friction modifier is effective in the early stages of use but the effect thereof fades away comparatively soon thereafter.

Thus, the present inventor has made intensive studies with a view to finding a solution in these previous problems and developing an engine oil capable of taking an effect to steadily reduce the friction loss of an engine for a long period of time.

As the result, it has been found that said object can be achieved by incorporating into a base oil an organomolybdenum compound, a boronic succinimide and an alkaline earth metal salt of salicylic acid. The present invention has been completed on the basis of this finding.

SUMMARY OF THE INVENTION

An object of the present invention is to provide an engine oil composition capable of reducing the friction loss of an engine.

Another object of the present invention is to provide an engine oil composition having the low friction properties not only in the early stages of use but also after it is used for a certain period of time.

Still another object of the present invention is to provide an engine oil composition which is excellent in a stability against heat and oxidation and has low oil consumption.

Specifically, the present invention provides an engine oil composition which comprises as the essential components (A) a base oil selected from a mineral oil and a synthetic oil, (B) 1 to 10% by weight of a boron compound derivative of alkenylsuccinimide, (C) 1 to 10% by weight of an alkaline earth metal salt of salicylic acid and (D) 100 to 2000ppm of a molybdenum compound (in terms of molybdenum atoms) selected from a molybdenum dithiophosphate and a molybdenum dithiocarbamate.

DESCRIPTION OF PREFERRED EMBODIMENT

As the base oil (component (A)) of the engine oil composition of the present invention, various mineral oils and synthetic oils can be used. Ordinarily it comprises either or both of a mineral oil and a synthetic oil each having a kinematic viscosity of 1 to 100cSt at 100° C.

Examples of the mineral oil to be used herein include a paraffinic mineral oil, an intermediate mineral oil and a naphthenic mineral oil. On the other hand, various synthetic oils can be used herein, including a (co)polymer (including an oligomer) of olefin having 2 to 16 carbon atoms, an alkylbenzene, an alkylnaphthalene and various esters or fatty acid esters such as neopentylglycol, trimethylolpropane and pentaerythritol. These mineral and synthetic oils can be used not only singly but also in their mixture at a discretionary ratio.

The component (B) of the engine oil composition of the present invention includes various boron compound derivatives of alkenylsuccinimide which are manufactured according to many different methods.

There are, for example (1) a product obtained by reacting an alkyl-substituted succinic anhydride with a reaction product between an alkyleneamine and a boron compound (Japanese Patent Publication No. 8013/1967), (2) a product obtained by reacting an alkyleneamine with a reaction product between a hydrocarbon-substituted succinic anhydride and a boron compound (Japanese Patent Publication No. 8014/1967), (3) a product obtained by reacting a primary amino boron compound containing hydroxyl groups with an alkenylsuccinic anhydride (Japanese Patent Application Laid-Open No. 52381/1976), (4) a product obtained by reacting a boron compound with a product which results from the reaction of an aromatic polybasic carboxylic acid, an alkenylsuccinic acid and a polyalkylenepolyamine at a specific molar ratio (Japanese Patent Application Laid-Open No. 130408/1976), (5) a condensation product among an amino alcohol, a boric acid and an oxyethanecarboxylic acid (Japanese Patent Application Laid-Open No. 87705/1979) and (6) a product obtained by reacting a polyalkyleneglycol, a secondary alkanolamine and a boron compound with a polyalkenylsuccinic anhydride one after another.

Specifically, a boron compound of polybutenyl (number-average molecular weight of 500 to 5000) succinimide can be mentioned.

These boron compound derivatives of alkenylsuccinimide are ordinarily compounded into the composition as the whole in an amount of 1 to 10% by weight, preferably 2 to 8% by weight. When the amount is less than 1% by weight, the effect aimed by the present invention cannot be obtained. When the amount is more than 10% by weight, the effect cannot be obtained in proportion thereto and it is not necessary to compound these compounds in such a large amount.

As the component (C) of the engine oil composition of the present invention, various alkaline earth metal salts of salicylic acid can be used. Preferable is a salicylate compound represented by the general formula (I):

(I)

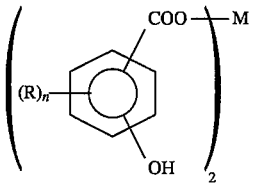

wherein R is a hydrogen atom or an alkyl group having 1 to 30 carbon atoms, n is an integer from 1 to 4 and M is an alkaline earth metal, especially Ca, Ba or Mg.

Among various salicylate compounds, calcium salicylate and magnesium salicylate are most suitable.

These alkaline earth metal salts of salicylic acid are ordinarily compounded into the composition as the whole in an amount of 1 to 10% by weight, preferably 2 to 6% by weight. When the amount is less than 1% by weight, the effect aimed by the present invention cannot be obtained. When the amount is more than 10% by weight, the effect cannot be obtained in proportion thereto and it is not necessary to compound them in such a large amount.

Now, in the engine oil composition of the present invention comprising the boron compound derivative of alkenylsuccinimide as the component (B) and the alkaline earth metal salt of salicylic acid as the component (C), the ratio by concentration of boron to alkaline earth metal is 0.5 to 50, preferably 0.5 to 10 expressed in terms of atomic ratio.

When the atomic ratio of boron/alkaline earth metal is less than 0.5, the engine is susceptible to a large friction loss in the early stages of using the engine oil composition. When that ratio is more than 50, a large friction loss is liable to occur in the engine after the engine oil composition is deteriorated.

Furthermore, as the component (D) of the engine oil composition of the present invention, the molybdenum compound includes either or both of molybdenum dithiophosphate (MoDTP) and molybdenum dithiocarbamate (MoDTC). Of them molybdenum dithiocarbamate is preferable. This MoDTP includes molybdenum dialkyl (or diaryl) dithiophosphate such as molybdenum diisopropyldithiophosphate, molybdenum di-(2-ethylhexyl) dithiophosphate and molybdenum di-(nonylphenyl) dithiophosphate. MoDTC includes molybdenum dialkyldithiocarbamate such as molybdenum dibutyldithiocarbamate, molybdenum di-(2-ethylhexyl) dithiocarbamate and molybdenum dilauryldithiocarbamate.

These molybdenum compounds are ordinarily compounded into the composition as the whole in an amount of 100 to 2000 ppm, preferably 200 to 1500 ppm (in terms of molybdenum atoms). When the amount is less than 100 ppm, the effect aimed by the present invention cannot be obtained. When the amount is more than 2000 ppm, detergency may occasionally be deteriorated in the engine oil composition.

The engine oil composition of the present invention is prepared basically by compounding the components (A), (B), (C) and (D) as the essential components but when necessary various additives can be compounded thereinto.

For example, the additives capable of providing the composition with the better engine oil capabilities can be compounded as desired, including viscosity index improver, pour point depressant, antioxidant, detergent-dispersant, anti-wear agent, rust preventive and the like. Specifically, examples of the viscosity index improver include polymethacrylate, polyisobutylene, ethylene-propylene copolymer, styrene-dienehydride copolymer and the like. Examples of the pour point depressant include polyalkylmethacrylate, phenol condensation product, naphthalene condensation product and the like. Examples of the antioxidant include hindered phenolic antioxidant (for example, 2, 6-di-tert-butylparacresol and the like), amine-based antioxidant (for example, α-naphthylamine, phenylnaphthylamine and the like), phosphoric antioxidant and the like. Examples of the detergent-dispersant include a sulfonate, a phenate and the like. These additives are compounded into the composition when necessary.

Desirable among other additives is zinc dialkyldithiophosphate and more desirable is secondary alkyl type zinc dialkyldithiophosphate (most desirable is a member thereof containing 50% or more by weight of secondary alkyl groups in the total amount of all alkyl groups (including organic residues other than the alkyl groups such as aryl group) of zinc dialkyldithiophosphate).

As stated above, the present invention provides an engine oil composition capable of reducing the friction loss of an engine and having the low friction properties not only in the early stages of the use thereof but also after it is used for a certain period of time.

Next, the present invention will be described in greater detail with reference to examples and comparative examples. Table 1 shows the compounding ratio of the components for preparation of the engine oil composition in the examples and the comparative examples.

TABLE 1

Compounding Ratio (wt %) of Engine Oil Composition

| | | Examples | | | |
|---|---|---|---|---|---|
| | | 1 | 2 | 3 | 4 |
| A | 100N mineral oil[1)] | 81.5 | 82.5 | 81.5 | 81.5 |
| B | Boronic succinimide A[2)] | 5 | 5 | — | 2 |
| | Boronic succinimide B[3)] | — | — | 5 | — |
| | For comparison | | | | |
| | Succinimide[4)] | — | — | — | 3 |
| | Mannich base[5)] | — | — | — | — |
| C | Ca salicylate[6)] | 3.5 | 3.5 | 3.5 | 3.5 |
| | For comparison | | | | |
| | Ca sulfonate[7)] | — | — | — | — |
| | Ca phenate[8)] | — | — | — | — |
| D | MoDTC[9)] | 2 | — | 2 | 2 |
| | MoDTP[10] | — | 1 | — | — |
| Other components | | | | | |
| Polymethacrylate[11)] | | 5 | 5 | 5 | 5 |
| Antioxidant & other[12)] | | 3 | 3 | 3 | 3 |
| Properties | | | | | |
| Mo content (ppm) | | 700 | 700 | 700 | 700 |
| Boron/Alkaline earth metal (atomic ratio) | | 2.0 | 2.0 | 1.2 | 0.8 |
| Engine valve train friction torque (kg · m) | New oil | 0.27 | 0.27 | 0.27 | 0.28 |
| | Aft. 50 hr deterioration | 0.27 | 0.29 | 0.28 | 0.29 |

| | | Comparative Examples | | |
|---|---|---|---|---|
| | | 1 | 2 | 3 |
| A | 100N mineral oil[1)] | 81.5 | 81.5 | 83 |
| B | Boronic succinimide A[2)] | — | — | 5 |
| | Boronic succinimide B[3)] | — | — | — |
| | For comparison | | | |
| | Succinimide[4)] | 5 | — | — |
| | Mannich base[5)] | — | 5 | — |

TABLE 1-continued

| Compounding Ratio (wt %) of Engine Oil Composition | | | | |
|---|---|---|---|---|
| C | Ca salicylate[6] | 3.5 | 3.5 | — |
| | For comparison | | | |
| | Ca sulfonate[7] | — | — | 2 |
| | Ca phenate[8] | — | — | — |
| D | MoDTC[9] | 2 | 2 | 2 |
| | MoDTP[10] | — | — | — |
| Other components | | | | |
| Polymethacrylate[11] | | 5 | 5 | 5 |
| Antioxidant & other[12] | | 3 | 3 | 3 |
| Properties | | | | |
| Mo content (ppm) | | 700 | 700 | 700 |
| Boron/Alkaline earth metal (atomic ratio) | | — | — | 1.2 |
| Engine valve train friction torque (kg · m) | New oil | 0.31 | 0.31 | 0.32 |
| | Aft. 50 hr deterioration | 0.34 | 0.36 | 0.36 |

| | | Comparative Examples | | |
|---|---|---|---|---|
| | | 4 | 5 | 6 |
| A | 100N mineral oil[1] | 82.5 | 82 | 83 |
| B | Boronic succinimide A[2] | 5 | 0.5 | 5 |
| | Boronic succinimide B[3] | — | — | — |
| | For comparison | | | |
| | Succinimide[4] | — | 4 | — |
| | Mannich base[5] | — | — | — |
| C | Ca salicylate[6] | — | 3.5 | — |
| | For comparison | | | |
| | Ca sulfonate[7] | — | — | 2 |
| | Ca phenate[8] | 2.5 | — | — |
| D | MoDTC[9] | 2 | 2 | 2 |
| | MoDTP[10] | — | — | — |
| Other components | | | | |
| Polymethacrylate[11] | | 5 | 5 | 5 |
| Antioxidant & other[12] | | 3 | 3 | 3 |
| Properties | | | | |
| Mo content (ppm) | | 700 | 700 | 700 |
| Boron/Alkaline earth metal (atomic ratio) | | 1.6 | 0.2 | 1.6 |
| Engine valve train friction torque (kg · m) | New oil | 0.31 | 0.30 | 0.33 |
| | Aft. 50 hr deterioration | 0.35 | 0.33 | 0.36 |

Antioxidant and other in Comparative Example 6:

A primary alkyl type zinc dialkyldithiophosphate was compounded.

Furthermore, there are the explanatory notes for Table 1 here, as follows:

1): A 100 neutral mineral oil purified by a solvent.

2): A boron compound of polybutenylsuccinimide, boron=2% by weight, nitrogen=2.1% by weight 3): A boron compound of polybutenylsuccinimide, boron=1.4% by weight, nitrogen=1.4% by weight 4): A polybutenylsuccinimide, nitrogen=2% by weight 5): A Mannich base, nitrogen=1.4% by weight 6): A Ca salicylate, Ca=6% by weight 7): A Ca sulfonate, Ca=12% by weight 8): A Ca phenate, Ca=9.3% by weight 9): A molybdenum di-(2-ethylhexyl) dithiocarbamate, Mo=3.5% by weight 10): A molybdenum di-(2-ethylhexyl) dithiophosphate, Mo=7% by weight 11): A polymethacrylate, weight-average molecular weight (Mw)=200,000

12): A secondary alkyl type zinc dialkyldithiophosphate (Zn in oil=0.11% by weight), phenolic antioxidant (0.5% by weight), a defoaming agent and others Examples 1 to 4 and Comparative Examples 1 to 6:

These examples and comparative examples were carried out as follows:

From a SOHC (single overhead camshaft) engine of 1500 cc displacement, an engine head (a valve train part) was removed. The camshaft thereof was driven by a motor and the torque then loaded on the camshaft was measured.

The camshaft was caused to rotate at 750 rpm and an engine oil was fed to the engine head at a rate of 1 liter/min at a temperature of 80° C.

The test oils used were a new oil and an oil which was deteriorated by treating the same with an engine of a 2200 cc displacement operating as if in a high speed driving trip for 50 hours.

The performance was evaluated as set forth above and the results thereof are given in Table 1.

As evident from Table 1, the test results were excellent in the examples of the present invention as compared with those of the comparative examples. Especially, in all examples, the friction torque was found to remain entirely unchanged whether it was tested with the new oil or the oil deteriorated by the 50-hour treatment.

What is claimed is:

1. An engine oil composition which comprises as the essential components (A) a base oil, (B) 1 to 10% by weight of a boron compound derivative of alkenylsuccinimide, (C) 1 to 10% by weight of an alkaline earth metal salt of salicylic acid and (D) 100 to 2000 ppm of at least one molybdenum compound (in terms of molybdenum atoms) selected from the group consisting of a molybdenum dithiophosphate and a molybdenum dithiocarbamate; the ratio by concentration of boron in component (B) to alkaline earth metal in component (C) being 0.5 to 10 expressed in terms of atomic ratio.

2. The engine oil composition according to claim 1, wherein the base oil is a mineral oil having a kinematic viscosity of 1 to 100 cSt at 100° C.

3. The engine oil composition according to claim 1, wherein the base oil is a synthetic oil having a kinematic viscosity of 1 to 100 cSt at 100° C.

4. The engine oil composition according to claim 1, further comprising a secondary alkyl type zinc dialkyldithiophosphate.

5. The engine oil composition according to claim 1, wherein the alkaline earth metal salt of salicylic acid is a salicylate compound represented by the general formula:

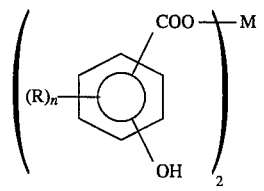

wherein R is a hydrogen atom or an alkyl group having 1 to 30 carbon atoms, n is an integer from 1 to 4 and M is an alkaline earth metal selected from the group consisting of Ca, Ba and Mg.

6. The engine oil composition according to claim 1, wherein the molybdenum dithiophosphate is a molybdenum diisopropyldithiophosphate, a molybdenum di-(2-ethylhexyl ) dithiophosphate or a molybdenum di-(nonylphenyl) dithiophosphate.

7. The engine oil composition according to claim 1, wherein the molybdenum dithiocarbamate is a molybdenum dibutyldithiocarbamate, a molybdenum di-(2-ethylhexyl )dithiocarbamate or a molybdenum dilauryldithiocarbamate.

8. The engine oil composition according to claim 1, wherein the base oil is a mixture of a mineral oil and a synthetic oil each having a kinematic viscosity of 1 to 100 cSt at 100° C.

* * * * *